US006518231B2

(12) United States Patent
Appel et al.

(10) Patent No.: US 6,518,231 B2
(45) Date of Patent: Feb. 11, 2003

(54) ENHANCEMENT OF AIR BLEACHING CATALYSTS

(75) Inventors: Rene Appel, Vlaardingen (NL); Ronald Hage, Vlaardingen (NL); Philippus Cornelis van der Hoeven, Vlaardingen (NL); Joachim Lienke, Vlaardingen (NL); Richard George Smith, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/013,620

(22) Filed: Dec. 11, 2001

(65) Prior Publication Data

US 2002/0169096 A1 Nov. 14, 2002

(30) Foreign Application Priority Data

Dec. 18, 2000 (GB) ..... 0030877

(51) Int. Cl.[7] ..... C11D 3/395
(52) U.S. Cl. ..... 510/367; 510/375; 510/399
(58) Field of Search ..... 510/367, 302, 510/309, 372, 375, 399

(56) References Cited

U.S. PATENT DOCUMENTS

| | | | | |
|---|---|---|---|---|
| 4,728,455 | A | 3/1988 | Rerek | |
| 5,244,594 | A | 9/1993 | Favre et al. | |
| 5,622,646 | A * | 4/1997 | Scialla et al. | 252/186.33 |
| 5,853,428 | A | 12/1998 | Collins et al. | |
| 6,074,437 | A | 6/2000 | Racherla et al. | |
| 6,140,294 | A | 10/2000 | Delroisse et al. | |
| 6,165,963 | A | 12/2000 | Delroisse et al. | |
| 6,242,409 | B1 | 6/2001 | Appel et al. | |
| 6,245,115 | B1 | 6/2001 | Appel et al. | |
| 6,451,752 | B1 * | 9/2002 | Delroisse et al. | 510/370 |

FOREIGN PATENT DOCUMENTS

| | | |
|---|---|---|
| DE | 197 55 493 | 12/1997 |
| EP | 0 070 074 | 7/1982 |
| EP | 0 205 208 | 5/1986 |
| EP | 0 206 390 | 5/1986 |
| EP | 0 214 761 | 8/1986 |
| EP | 0 218 272 | 8/1986 |
| EP | 0 258 068 | 8/1987 |
| EP | 0 328 177 | 1/1989 |
| EP | 0 331 376 | 2/1989 |
| EP | 0 346 995 | 6/1989 |
| EP | 0 458 379 | 11/1991 |
| EP | 0 909 809 | 9/1998 |
| EP | 0 999 050 | 11/1999 |
| WO | 89/09263 | 10/1989 |
| WO | 91/05839 | 5/1991 |
| WO | 94/12619 | 6/1994 |
| WO | 94/12620 | 6/1994 |
| WO | 94/12621 | 6/1994 |
| WO | 95/34628 | 12/1995 |
| WO | 96/06154 | 2/1996 |
| WO | 97/11217 | 3/1997 |
| WO | 97/30144 | 8/1997 |
| WO | 97/31000 | 8/1997 |
| WO | 97/38074 | 10/1997 |
| WO | 97/48787 | 12/1997 |
| WO | 98/32832 | 7/1998 |
| WO | 98/38288 | 9/1998 |
| WO | 98/39098 | 9/1998 |
| WO | 98/39406 | 9/1998 |
| WO | 98/59028 | 12/1998 |
| WO | 99/02632 | 1/1999 |
| WO | 99/02638 | 1/1999 |
| WO | 99/02639 | 1/1999 |
| WO | 99/02641 | 1/1999 |
| WO | 99/01927 | 2/1999 |
| WO | 99/23887 | 5/1999 |
| WO | 99/65905 | 12/1999 |
| WO | 00/12667 | 3/2000 |
| WO | 00/12808 | 3/2000 |
| WO | 00/29537 | 5/2000 |
| WO | 00/34427 | 6/2000 |
| WO | 00/52124 | 9/2000 |
| WO | 00/60043 | 10/2000 |
| WO | 00/60044 | 10/2000 |
| WO | 00/60045 | 10/2000 |
| WO | 01/16268 | 3/2001 |
| WO | 01/16271 | 3/2001 |

OTHER PUBLICATIONS

GB Search Report.
International Search Report.

* cited by examiner

*Primary Examiner*—Yogendra N. Gupta
*Assistant Examiner*—John M. Petruncio
(74) *Attorney, Agent, or Firm*—Milton L. Honig

(57) ABSTRACT

The invention relates to catalytically bleaching substrates, especially laundry fabrics, with atmospheric oxygen or air in the presence of an air bleaching facilitator.

13 Claims, No Drawings

ENHANCEMENT OF AIR BLEACHING CATALYSTS

FIELD OF INVENTION

This invention relates to the enhancement of air bleaching catalysts in laundry.

BACKGROUND OF INVENTION

The use of bleaching catalysts for stain removal has been developed over recent years. The recent discovery that some catalysts are capable of bleaching effectively in the absence of an added peroxyl source has recently become the focus of some interest, for example: WO9965905; WO0012667; WO0012808; WO0029537, and, WO0060045.

Ways of enhancing the activity or improving the stain bleaching profile of these catalysts are desired.

SUMARY OF INVENTION

We have found that the presence of an organic substance having an allylic hydrogen enhances the effectiveness of an air bleaching catalyst in use. The organic substance is provided in a bleaching composition as either an ionic unsaturated surfactant and/or unsaturated non-ionic surfactant.

The present invention provides a bleaching composition comprising an organic substance which forms a complex with a transition metal for bleaching a substrate with atmospheric oxygen, the bleaching composition upon addition to an aqueous medium providing an aqueous bleaching medium substantially devoid of a peroxygen bleach or a peroxy-based or peroxyl-generating bleach system, said composition comprising a surfactant having an allylic hydrogen and an HLB of greater than 2.

The surfactant having an allylic hydrogen has an HLB (hydrophilic/lipophilic balance) greater that 2, more preferably greater than 5, and most preferably greater than 10. For a discussion of HLB the reader is directed to and article by Griffin, W. C. in J. Soc. Cosmetic Chemists Vol. 1 page 311, 1945 and Davies, J. T. and Rideal, E. K. in Interfacial Phenomena, Acad. Press, NY, 1961, pages 371 to 382. The HLB value requirement reflects the importance of the rate of solubility and dispersibility of the surfactant having an allylic hydrogen from the bleaching composition to the aqueous wash medium in conjunction with surface activity towards the substrate being washed. The threshold value of HLB as required excludes compounds that have an allylic which do not have the required surfactant properties, for example linoleaic or oleic acid have an HLB of 0.8.

It is preferred that the surfactant having an allylic hydrogen has a CMC of $2\times10^{-2}$ M or less. It is most preferred that the surfactant is anionic has a critical micelle concentration value of $3\times10^{-3}$ M or less. Generally, a surfactant will form a micelle when present in an aqueous solution above a specific concentration that is intrinsic to the surfactant. A micelle is a neutral or electrically charged colloidal particle, consisting of oriented molecules. Above what is known as the critical micelle concentration CMC amphiphilic compounds tend to adopt specific aggregates in aqueous solution. The tendency is to avoid contact between their hydrophobic alkyl chains and the aqueous environment and to form an internal hydrophobic phase. Such compounds can form monomolecular layers [monolayers] at the air-water boundary and bimolecular layers [bilayers] between two aqueous compartments. Micelles are spherically closed monolayers.

The property required is that the surfactant used in the present invention is and forms a micelle at a concentration of $2\times10^{-2}$ M and below in an aqueous solution at a temperature of 25° C. One skilled in the art will be aware that the standard CMC is measured in deionized water and that the presence of other components in solution, e.g. surfactants or ions in solution will perturb the CMC value. The CMC values and requirement thereof as described herein are measured under standard conditions (N. M. Van Os, J. R. Haak, and L. A. M Rupert, Pysico Chemical Properties of Selected Anionic Cationic and Nonionic Surfactants Elsevier 1993; Kresheck, G. C. Surfactants-In water a comparative treatise- (ed. F. Franks) Chapter 2 pp 95–197 Plenum Press 1971, New York; and, Mukerjee, P. and Mysels K. J. Critical Micelle Concentrations of Aqueous Surfactant Systems, NSRDS-NBS 36, National Bureau of Standards. US Gov. Print office 1971, Washington, D.C.).

The term "substantially devoid of a peroxygen bleach or a peroxy-based or peroxyl-generating bleach system" should be construed within spirit of the invention. It is preferred that the composition has as low a content of peroxyl species present as possible. Nevertheless, autoxidation is something that is very difficult to avoid and as a result small levels of peroxyl species may be present. These small levels may be as high as 2%. The additionally added organic compounds having labile CH's are particularly susceptible to autoxidation and hence may contribute more to this level of peroxyl species than other components. However the presence of an antioxidant in the composition will serve to reduce the presence of adventitious peroxyl species. The composition of the present invention bleaches a substrate with at least 10%, preferably at least 50% and optimally at least 90% of any bleaching of the substrate being effected by oxygen sourced from the air.

The present invention extends to a method of bleaching a substrate comprising applying to the substrate, in an aqueous medium, the bleaching composition according to the present invention.

The present invention extends to a commercial package comprising the bleaching composition according to the present invention together with instructions for its use.

The bleaching composition may be contacted to the textile fabric in any suitable manner. For example, it may be applied in dry form, such as in powder form, or in a liquor that is then dried, for example as an aqueous spray-on fabric treatment fluid or a wash liquor for laundry cleaning, or a non-aqueous dry cleaning fluid or spray-on aerosol fluid.

Any suitable textile that is susceptible to bleaching or one that one might wish to subject to bleaching may be used. Preferably the textile is a laundry fabric or garment.

In a preferred embodiment, the method according to the present invention is carried out on a laundry fabric using an aqueous treatment liquor. In particular, the treatment may be effected in a wash cycle for cleaning laundry. More preferably, the treatment is carried out in an aqueous detergent bleach wash liquid.

In a preferred embodiment, the treated textile is dried, by allowing it to dry under ambient temperature or at elevated temperatures. The elevated temperatures are commonly provided by a heated agitated environment, as for example found in a tumble dryer, which has been found to accelerate and enhance the air bleaching effect. The effect of ironing the treated textile also serves to accelerate bleaching.

The bleaching method may be carried out by simply leaving the substrate in contact with the bleaching composition for a sufficient period of time. Preferably, however, the bleaching composition is in an aqueous medium, and the aqueous medium on or containing the substrate is agitated.

The bleaching composition may be contacted with the textile fabric in any conventional manner. For example it may be applied in dry form, such as in powder form, or in a liquor that is then dried, for example in an aqueous spray-on fabric treatment fluid or a wash liquor for laundry cleaning, or a non-aqueous dry cleaning fluid or spray-on aerosol fluid.

In a particularly preferred embodiment the method according to the present invention is carried out on a laundry fabric using aqueous treatment liquor. In particular the treatment may be effected in, or as an adjunct to, an essentially conventional wash cycle for cleaning laundry. More preferably, the treatment is carried out in an aqueous detergent wash liquor. The bleaching composition can be delivered into the wash liquor from a powder, granule, pellet, tablet, block, bar or other such solid form. The solid form can comprise a carrier, which can be particulate, sheet-like or comprise a three-dimensional object. The carrier can be dispersible or soluble in the wash liquor or may remain substantially intact. In other embodiments, the bleaching composition can be delivered into the wash liquor from a paste, gel or liquid concentrate.

A unit dose as used herein is a particular amount of the bleaching composition used for a type of wash. The unit dose may be in the form of a defined volume of powder, granules or tablet.

DETAILED DESCRIPTION OF THE INVENTION

The bleach catalyst per se may be selected from a wide range of organic molecules (ligands) and complexes thereof. Suitable organic molecules (ligands) and complexes for use with the present invention are found, for example in: GB 9906474.3; GB 9907714.1; GB 98309168.7, GB 98309169.5; GB 9027415.0 and GB 9907713.3; DE 19755493; EP 999050; WO-A-9534628; EP-A-458379; EP 0909809; U.S. Pat. No. 4,728,455; WO-A-98/39098; WO-A-98/39406, WO 9748787, WO 0029537; WO 0052124, and WO0060045 the complexes and organic molecule (ligand) precursors of which are herein incorporated by reference. The air bleaching catalysts as used herein should not be construed as an peroxyl-generating system, alone or in combination with other substrates, irrespective of how they bleaching action works.

Another example of an air bleaching catalyst is a ligand or transition metal catalyst thereof of a ligand having the formula (I):

(I)

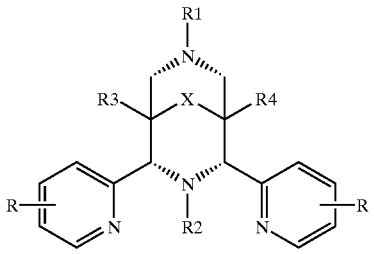

wherein each R is independently selected from: hydrogen, hydroxyl, and C1–C4-alkyl;

R1 and R2 are independently selected from:
C1–C4-alkyl,
C6–C10-aryl, and,
a group containing a heteroatom capable of coordinating to a transition metal, wherein at least one of R1 and R2 is the group containing the heteroatom;

R3 and R4 are independently selected from hydrogen, C1–C8 alkyl, C1–C8-alkyl-O—C1–C8-alkyl, C1–C8-alkyl-O—C6–C10-aryl, C6–C10-aryl, C1–C8-hydroxyalkyl, and —$(CH2)_n$C(O)OR5 wherein R5 is C1–C4-alkyl, n is from 0 to 4, and mixtures thereof; and, X is selected from C═O, —$[C(R6)_2]_y$- wherein Y is from 0 to 3 each R6 is independently selected from hydrogen, hydroxyl, C1–C4-alkoxy and C1–C4-alkyl.

It is preferred that the group containing the heteroatom is:

a heterocycloalkyl: selected from the group consisting of: pyrrolinyl; pyrrolidinyl; morpholinyl; piperidinyl; piperazinyl; hexamethylene imine; 1,4-piperazinyl; tetrahydrothiophenyl; tetrahydrofuranyl; tetrahydropyranyl; and oxazolidinyl, wherein the heterocycloalkyl may be connected to the ligand via any atom in the ring of the selected heterocycloalkyl, a —C1–C6-alkyl-heterocycloalkyl, wherein the heterocycloalkyl of the —C1–C6-heterocycloalkyl is selected from the group consisting of: piperidinyl; piperidine; 1,4-piperazine, tetrahydrothiophene; tetrahydrofuran; pyrrolidine; and tetrahydropyran, wherein the heterocycloalkyl may be connected to the —C1–C6-alkyl via any atom in the ring of the selected heterocycloalkyl, a —C1–C6-alkyl-heteroaryl, wherein the heteroaryl of the —C1–C6-alkylheteroaryl is selected from the group consisting of: pyridinyl; pyrimidinyl; pyrazinyl; triazolyl; pyridazinyl; 1,3,5-triazinyl; quinolinyl; isoquinolinyl; quinoxalinyl; imidazolyl; pyrazolyl; benzimidazolyl; thiazolyl; oxazolidinyl; pyrrolyl; carbazolyl; indolyl; and isoindolyl, wherein the heteroaryl may be connected to the —C1–C6-alkyl via any atom in the ring of the selected heteroaryl and the selected heteroaryl is optionally substituted by —C1–C4-alkyl, a —C0–C6-alkyl-phenol or thiophenol, a —C2–C4-alkyl-thiol, thioether or alcohol, a —C2–C4-alkyl-amine, and a —C2–C4-alkyl-carboxylate.

It is preferred that the organic molecule (ligand) or transition metal complex is present in the composition such that a unit dose provides at least 0.1 $\mu$M of the organic molecule or transition metal complex thereof.

Surfactant Having an Allylic Hydrogen

To benefit from the enhancement of bleaching activity it is preferred that the surfactant having an allylic hydrogen is present in the composition such that a unit dose provides at least 0.01 g/l, more preferably at least 0.5 g /l, and most preferably at least 0.1 g /l, concentration of the unsaturated organic compound in a wash. The surfactant having an allylic hydrogen may be present in the composition in the range of 0.01 to 60%, preferably 0.1 to 20% and most preferably 10% w/w.

There are many classes of surfactants having an allylic hydrogen that will work with the present invention to enhance air bleaching. As one skilled in the art is aware a surfactant having an allylic hydrogen (enhancer) may be found in: neutral species, and charged species, i.e., cationic species, anionic species, and zwitterionic species. It is preferred that the surfactant having an allylic hydrogen contains a hydrophilic group thereby providing the organic compound unassociated or as a micelle in an aqueous medium. It also is preferred that the surfactant having an allylic hydrogen is provided in the form of an alkali metal salt, preferably sodium, of an unsaturated carboxylic acid.

One skilled in the art will appreciate that benzene and toluene are considered unsaturated but neither possess allylic hydrogens per se. The homolytic bond dissociation energy (BDE) for benzene (C6H5—H) is 110.9 kcal/mol (298 K) makes benzene moieties per se unsuitable to promote enhanced bleaching. The surfactant used to enhance bleaching according to the present invention has a hydrogen atom covalently bound to an alpha-carbon that is alpha to a Sp2—Sp2 hybridized bond (other than Sp2—Sp2 hybridized bonds found in a cyclic aromatic system) e.g., as shown as underlined in the following formula CH2═CH—C H2—CH3. It is most preferred that the surfactant having an allylic hydrogen has a molecular weight of at least 80 and a bond dissociation energy of less than 95 kcal/mol, most preferably below 90 kcal/mol, and even more preferably below 85 kcal/mol. Below is a table of bond strengths (298 K) obtained from: The handbook of Chemistry and Physics 73rd edition, CRC Press.

| Compound | BDE ΔH(kcal/mol) |
|---|---|
| (CH3)3CH | 93.3 ± 0.5 |
| H—CH2OCH3) | 93 ± 1 |
| C6H5—H | 110.9 ± 2.0 |
| H—CMe2OH | 91 ± 1 |
| CH3CH3 | 100.3 ± 1 |
| CH2═CH—CH2—CH3 | 83.1 ± 2.2 |
| CH2═CH—CH3 | 86.3 ± 1.5 |
| C6H5—CH3 | 88.0 ± 1 |
| CH3CH═CHCH═CH2 | 83 ± 3 |

1) Unsaturated Soap (Unsaturated Anionic Surfactant)

The unsaturated fatty acid soap used preferably contains from about 16 to about 22 carbon atoms, preferably in a straight chain configuration. Preferably the number of carbon atoms in the unsaturated fatty acid soap is from about 16 to about 18.

This unsaturated soap, in common with other anionic detergents and other anionic materials in the detergent compositions of this invention, has a cation, which renders the soap water-soluble and/or dispersible. Suitable cations include sodium, potassium, ammonium, monethanolammonium, diethanolammonium, triethanolammonium, tetramethylammonium, etc. cations. Sodium ions are preferred although in liquid formulations potassium, monoethanolammonium, diethanolammonium, and triethanolammonium cations are useful.

The unsaturated soaps are made from natural oils that often contain one or more unsaturated groups and consist of mixtures of components. It is clear that hydrolysation of these natural components yield mixtures of soaps, of which at least one of the components contain one or more unsaturated groups. Examples of natural oils are sunflower oil, olive oil, cottonseed oil, linseed oil, safflower oil, sesame oil, palm oil, corn oil, peanut oil, soybean oil, castor oil, coconut oil, canola oil, cod liver oil and the like, that give mixtures of soaps of which at least one of them has at least one unsaturated group. However, also hydrolysis products of purified oils, as listed above, may be employed. Other examples of soaps include thoses derived from erucic acid, 2) Unsaturated Surfactant (Unsaturated Cationic)

As one skilled in the art will appreciate such an unsaturated cationic may be manufactured, for example, by adding an unsaturated alkyl halide to an amine thus forming an unsaturated cationic.

In principle the cationic surfactants exhibit the same requirements as listed above for the unsaturated soap materials, except they need to be quarternised. Without limiting the scope of the invention, suitable cationics may be formed by preparing the quaternary salts from alcohols that were obtained from the corresponding fatty acid (as defined under 1; from oils containing unsaturated bonds).

Examples of cationic surfactants based on natural oils include oleylbis(2-hydroxyethyl)methylammonium chloride and ditallow fatty alkyldimethyl ammonium chloride.

3) Unsaturated Neutral Surfactant

An example of a non-ionic (neutral) surfactant is found in alkoxylated non-ionic surfactants. In common with the ionic surfactants as described above the surfactant has an allylic hydrogen.

The Detergent Composition

The Bleaching composition of the present invention may comprise other surfactants and optionally other conventional detergent ingredients.

In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$–$C_{22}$ alkyl phenol-ethylene oxide condensates, generally 5 to 25 EO, i.e. 5 to 25 units of ethylene oxide per molecule, and the condensation products of aliphatic $C_8$–$C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$–$C_{18}$ alcohols, produced for example from tallow or coconut oil, sodium and potassium alkyl $C_9$–$C_{20}$ benzene sulphonates, particularly sodium linear secondary alkyl $C_{10}$–$C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$–$C_{15}$ alkyl benzene sulphonates and sodium $C_{12}$–$C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system that is a mixture of an alkali metal salt of a $C_{16}$–$C_{18}$ primary alcohol sulphate together with a $C_{12}$–$C_{15}$ primary alcohol 3–7 EO ethoxylate.

The nonionic detergent is preferably present in amounts greater than 10%, e.g. 25–90% by weight of the surfactant system. Anionic surfactants can be present for example in amounts in the range from about 5% to about 40% by weight of the surfactant system.

The detergent composition may take any suitable physical form, such as a powder, granular composition, tablets, a paste or an anhydrous gel.

Enzymes

The detergent compositions of the present invention may additionally comprise one or more enzymes, which provide cleaning performance, fabric care and/or sanitation benefits.

Said enzymes include oxidoreductases, transferases, hydrolases, lyases, isomerases and ligases. Suitable members of these enzyme classes are described in Enzyme nomenclature 1992: recommendations of the Nomenclature Committee of the International Union of Biochemistry and Molecular Biology on the nomenclature and classification of enzymes, 1992, ISBN 0-12-227165-3, Academic Press.

Examples of the hydrolases are carboxylic ester hydrolase, thiolester hydrolase, phosphoric monoester hydrolase, and phosphoric diester hydrolase which act on the ester bond; glycosidase which acts on O-glycosyl compounds; glycosylase hydrolysing N-glycosyl compounds; thioether hydrolase which acts on the ether bond; and exopeptidases and endopeptidases which act on the peptide bond. Preferable among them are carboxylic ester hydrolase, glycosidase and exo- and endopeptidases. Specific examples of suitable hydrolases include (1) exopeptidases such as aminopeptidase and carboxypeptidase A and B and endopeptidases such as pepsin, pepsin B, chymosin, trypsin, chymotrypsin, elastase, enteropeptidase, cathepsin B, papain, chymopapain, ficain, thrombin, plasmin, renin, subtilisin, aspergillopepsin, collagenase, clostripain, kallikrein, gastricsin, cathepsin D, bromelain, chymotrypsin C, urokinase, cucumisin, oryzin, proteinase K, thermomycolin, thermitase, lactocepin, thermolysin, bacillolysin. Preferred among them is subtilisin; (2) glycosidases such as α-amylase, β-amylase, glucoamylase, isoamylase, cellulase, endo-1,3(4)-β-glucanase (β-glucanase), xylanase, dextranase, polygalacturonase (pectinase), lysozyme, invertase, hyaluronidase, pullulanase, neopullulanase, chitinase, arabinosidase, exocellobiohydrolase, hexosaminidase, mycodextranase, endo-1,4-β-mannanase (hemicellulase), xyloglucanase, endo-β-galactosidase (keratanase), mannanase and other saccharide gum degrading enzymes as described in WO-A-99/09127. Preferred among them are α-amylase and cellulase; (3) carboxylic ester hydrolase including carboxylesterase, lipase, phospholipase, pectinesterase, cholesterol esterase, chlorophyllase, tannase and wax-ester hydrolase. Preferred among them is lipase.

Examples of transferases and ligases are glutathione S-transferase and acid-thiol ligase as described in WO-A-98/59028 and xyloglycan endotransglycosylase as described in WO-A-98/38288.

Examples of lyases are hyaluronate lyase, pectate lyase, chondroitinase, pectin lyase, alginase II. Especially preferred is pectolyase, which is a mixture of pectinase and pectin lyase.

Examples of the oxidoreductases are oxidases such as glucose oxidase, methanol oxidase, bilirubin oxidase, catechol oxidase, laccase, peroxidases such as ligninase and those described in WO-A-97/31090, monooxygenase, dioxygenase such as lipoxygenase and other oxygenases as described in WO-A-99/02632, WO-A-99/02638, WO-A-99/02639 and the cytochrome based enzymatic bleaching systems described in WO-A-99/02641.

The activity of oxidoreductases, in particular the phenol oxidising enzymes in a process for bleaching stains on fabrics and/or dyes in solution and/or antimicrobial treatment can be enhanced by adding certain organic compounds, called enhancers. Examples of enhancers are 2,2'-azo-bis-(3-ethylbenzo-thiazoline-6-sulphonate (ABTS) and Phenothiazine-10-propionate (PTP). More enhancers are described in WO-A-94/12619, WO-A-94/12620, WO-A-94/12621, WO-A-97/11217, WO-A-99/23887. Enhancers are generally added at a level of 0.01% to 5% by weight of detergent composition.

Builders, polymers and other enzymes as optional ingredients may also be present as found in WO0060045.

Suitable detergency builders as optional ingredients may also be present as found in WO0034427.

The composition of the present invention may be used for laundry cleaning, hard surface cleaning (including cleaning of lavatories, kitchen work surfaces, floors, mechanical ware washing etc.). As is generally known in the art, bleaching compositions are also employed in waste-water treatment, pulp bleaching during the manufacture of paper, leather manufacture, dye transfer inhibition, food processing, starch bleaching, sterilisation, whitening in oral hygiene preparations and/or contact lens disinfection.

In the context of the present invention, bleaching should be understood as relating generally to the decolourisation of stains or of other materials attached to or associated with a substrate. However, it is envisaged that the present invention can be applied where a requirement is the removal and/or neutralisation by an oxidative bleaching reaction of malodours or other undesirable components attached to or otherwise associated with a substrate. Furthermore, in the context of the present invention bleaching is to be understood as being restricted to any bleaching mechanism or process that does not require the presence of light or activation by light.

The invention will now be further illustrated by way of the following non-limiting examples:

EXAMPLES

Example 1

Compound 1: [Fe(MeN4py)Cl]Cl.2$H_2O$ N,N-bis(pyridin-2-yl-methyl)-1,1-bis(pyridin-2-yl)-1-aminoethane (MeN4py) was prepared as described in EP 0 909 809 A2. [Fe(MeN4py)Cl]Cl.2$H_2O$ was prepared as described in WO 0116271.

Compound 2: [Fe(1,4-bis(quinolin-2-ylmethyl)-7-ethyl-1,4,7-triazacyclononane) Br]($ClO_4$): was synthesised as prepared as described in WO0116272.

Compound 3: [Fe(N,N,N-tris(3-methyl)pyridin-2yl-N-benzyl)Cl]$PF_6$ was prepared as described in EP 1001009.

Compound 4: [Fe(N,N,N-tris(3-methyl)pyridin-2yl-N-methyl)Cl]$PF_6$ was prepared as described in EP 1001009.

Compound 5: tetrakis(pyridin-2-ylmethyl) ethylenediamine (TPEN) was synthesised as described in: Toftlund, H.; Markiewicz, A.; Murray, K. S.; Acta Chem. Scamd., 44, 443 (1990).

TPEN (2 eq) was mixed with 1 equivalent of iron perchlorate in ethanol/water 1/1, left for 15 minutes and then used (yielding in the wash solution 10 microM Fe/20microM ligand denoted in the tables as 10 microM 5).

Compound 6: [$FeSO_4$(N2Py3u)]

Dimethyl 2,6-di-(2-pyridine)-1-(pyridin-2-ylmethyl)-piperid-4-one-3,5-dicarboxylate (NPy3) (MW: 460.5 g/mol) Picolylamine (0.05 ml; 5.1 ml) was added drop wise to an ice-bath cooled solution of acetonedicarboxylic acid dimethyl (0.05 mol; 7.2 ml) in methanol (30 ml) subsequent addition of 2-pyridinaldehyde (0.1 mol; 9.56 ml) yielded an orange red solution. The solution was stirred for 5 min at 0° C. and then cooled to 18° C. After approximately two days storage at 18° C. large crystals formed in the reaction mixture. The crystals were removed by filtration and washed with cold ethanol and recrystallised from ethanol. Further concentration of the filtrate yielded a further 10% of product to yield 19.31 g (84%).

$^1$H-NMR: ($DCCl_3$) (predominantly enol): 3.55; 3.81 (s, 6H, -OMe); 3.83 (s, 2H, $CH_2$-py); 4.29 (d, J=12 Hz, 1H, pipH4); 4.81 (d, J=12 Hz, 1H, pipH5); 4.89 (s, 1H, pipH2); 7.05–7.78 (m, 9H, pyHs); 8.42–8.48 (m, 2H, pyH6, pyH6); 8.62 (d, J=8 Hz), 1H, pyH6)

Dimethyl 2,4-di-(2-pyridyl)-3-(pyrid-2-ylmethyl)-7-methyl-3,7-diaza-bicyclo[3.3.1]nonan-9-one-1,5-dicarboxylate (N2Py3u) (MW: 515.22 g/mol)

To a suspension of NPy3 (21.79 g, 47.3 mmol) in 250 mL ethanol was added aqueous (40%) methylamine (4.8 mL, 56.7 mmol) and aqueous (37%) formaldehyde (9.2 ml, 113.4 mmol). The suspension was stirred under reflux for 3 h which resulted in a deep brown solution being formed. The solvent was removed under reduced pressure and the resulting green/brown solid was recrystallized from ethanol to yield 6.58 g (27%) of the title compound as a white solid.

$^1$H-NMR (300 MHz, $CDCl_3$): 2.20 (s, 3H, N-Me), 2.56 (d, 2H, J=12 Hz, bisH6ax, bisH8ax), 2.98 (d, 2H, $J_{HH}$=12 Hz, bisH6eq, bisH8eq), 3.72 (s, 8H, OMe, $CH_2$-Py), 5.42 (s, 2H, bisH2, bisH4), 6.76 (d, 1H, J=7.7 Hz, Py-H), 6.97 (t, 1H, J=5.7 Hz, Py-H), 7.13 (t, 2H, J=6.0 Hz, Py-H), 7.38 (t, 2H, J=7.6 Hz, Py-H), 7.68 (t, 2H, J=7.6 Hz, Py-H), 8.06 (d, 1H, J=7.6 Hz, Py-H), 8.43 (d, 1H, J=4.6 Hz, Py-H), 8.47 (d, 2H, J=4.4 Hz, Py-H).

Anal. Calcd for $C_{28}H_{29}N_5O_5$: C 65.23, H 5.67, N 13.58; found: C 64.86, H 5.60, N 13.41.

[$FeSO_4$ (N2Py3u)]

((Dimethyl-2,4-di-(2-pyridyl)-3-(pyridin-2-ylmethyl)-7-methyl-3,7-diaza-bicyclo[3.3.1]nonan-9-one-1,5-dicarboxylate)sulfatoiron(II) (M=667,13 g/mol) Anal. Calcd for $C_{28}H_{29}FeN_5O_9S$: C 46.61, H 4.89, N 9.71; found +3$H_2O$: C 47.27, H 4.81, N 9.88. FAB$^+$MS (nitrobenzylalcohol): 686.1 ($MH^+$+$H_2O$)

Compound 7: Dichloro-5,12-dimethyl-1,5,8,12-tetraazabicyclo[6.6.2]hexadecane Manganese(II) was prepared as described in WO 0029537.

Example 2

The results below are non-limiting and just intended for illustration of the invention. The results below illustrate the bleaching performance on a wide variety of stains in combination with a transition-metal catalyst and a soap derived from an unsaturated oil or an unsaturated oil. The stain does not need to contain unsaturated groups, as found usually in the tomato-oil or curry oil stains (that are bleached by the metal complexes in the air).

Results of bleaching of various stains by air using a formulation containing an unsaturated soap and [Fe(MeN4py)Cl]Cl in the absence of a peroxy compound.

In an aqueous solution containing 10 mM carbonate buffer (pH 10) with 0.6 g/l or 6 g/l sodium-linoleate and the catalyst (10 or 100 $\mu$M), BC-1 (tea stain) cloths, or CS-12 (blackcurrant fruit stain) cloths, or grass stains or tomato/saturated oil (medium-chain C8-saturated triglyceride) were added and kept in contact with the solution under agitation for 30 minutes at 30° C. In comparitive experiments, either only the soap was added (no catalyst) or the catalyst only was added (no soap). After the wash, the cloths were rinsed with water and subsequently dried at 30° C. and the change in colour was measured immediately after drying with a Linotype-Hell scanner (ex Linotype) (t=0 in the table). The tomato stains were left for 24 h and 48 h in the dark and measured again (t=1 and t=2 in the tables). The change in colour (including bleaching) is expressed as the ΔE value versus white; a lower ΔE value means a cleaner cloth. The measured colour difference (ΔE) between the washed cloth and the unwashed cloth is defined as follows:

$$\Delta E=[(\Delta L)^2+(\Delta a)^2+(\Delta b)^2]^{1/2}$$

wherein ΔL is a measure for the difference in darkness between the washed and unwashed test cloth; Δa and Δb are measures for the difference in redness and yellowness respectively between both cloths. With regard to this colour measurement technique, reference is made to Commission International de l'Eclairage (CIE); Recommendation on Uniform Colour Spaces, colour difference equations, psychometric colour terms, supplement no 2 to CIE Publication, no 15, Colormetry, Bureau Central de la CIE, Paris 1978. The results are shown below in the tables.

Bleach Results

Table 1 shows BC-1 stain (tea stain) bleaching results.

| | ΔE |
|---|---|
| No additive | 15 |
| 0.6 g/l Na-linoleate | 15 |
| 10 $\mu$M 1 | 15 |
| 0.6 g/l Na-linoleate + 10 $\mu$M 1 | 13 |

The results in the Table 1 above show a bleach benefit by combining a soap containing an unsaturated bond with the catalyst using air.

Table 2 shows CS-12 stain (blackcurrant fruit stain) bleaching results.

| | ΔE |
|---|---|
| No additive | 13 |
| 0.6 g/l Na-linoleate | 13 |
| 6 g/l Na-linoleate | 13 |
| 10 $\mu$M 1 | 13 |
| 0.6 g/l Na-linoleate + 10 $\mu$M 1 | 11 |
| 6 g/l Na-linoleate + 10 $\mu$M 1 | 10 |

The results in the Table 2 above show a bleach benefit by combining a soap containing an unsaturated bond with the catalyst using air.

Table 3 shows grass stain bleaching results.

| | ΔE |
|---|---|
| No additive | 35 |
| 0.6 g/l Na-linoleate | 18 |
| 6 g/l Na-linoleate | 12 |
| 10 $\mu$M 1 | 31 |
| 0.6 g/l Na-linoleate + 10 $\mu$M 1 | 9 |
| 6 g/l Na-linoleate + 10 $\mu$M 1 | 6 |

The results in the Table 3 above show a bleach benefit by combining a soap containing an unsaturated bond with the catalyst using air.

Table 4 shows tomato saturated oil stain bleaching results.

| | ΔE (t = 0) | ΔE (t = 1) |
|---|---|---|
| No additive | 19 | 19 |
| 0.6 g/l Na-linoleate | 17 | 17 |
| 6 g/l Na-linoleate | 14 | 14 |
| 10 μM 1 | 18 | 18 |
| 100 μM 1 | 20 | 20 |
| 0.6 g/l Na-linoleate + 10 μM 1 | 7 | 3 |
| 0.6 g/l Na-linoleate + 100 μM 1 | 16 | 6 |
| 6 g/l Na-linoleate + 10 μM 1 | 5 | 2 |
| 6 g/l Na-linoleate + 100 μM 1 | 3 | 2 |

The results in Table 4 above show a bleach benefit by combining a soap containing an unsaturated bond with the catalyst using air. This bleaching effect continues during storage in the dark.

Another series of catalysts were tested on another saturated oil tomato stain batch (having a different intensity) using Na-linoleate (Na-linoleate has an HLB of 17.8 and a CMC of $1.8\times10^{-3}$ M at 20° C.) and Na-oleate (Na-oleate has an HLB of 17.8 and CMC of $7.3\times10^{-4}$ M at 20° C.) as enhancing molecules. All experiments were done in the presence of 0.6 g/L NaLAS. Only values are given in the table when based on statistic analysis (2 times standard deviation of buffer/LAS only).

Results are given in table 5.

| | ΔE (t = 0) | ΔE (t = 1) | ΔE (t = 2) |
|---|---|---|---|
| No additive | 27 | 27 | 28 |
| 0.6 g/l Na-linoleate | 27 | 27 | 28 |
| 0.6 g/l Na-linoleate + 10 μM 2 | 21 | 10 | 8 |
| 0.6 g/l Na-linoleate + 10 μM 3 | 23 | 18 | 16 |
| 0.6 g/l Na-linoleate + 10 μM 4 | 23 | 19 | 18 |
| 0.6 g/l Na-linoleate + 10 μM 5 | — | 24 | 22 |
| 0.6 g/l Na-linoleate + 10 μM 6 | — | 10 | 8 |
| 0.6 g/l Na-linoleate + 10 μM 7 | 24 | 8 | 7 |
| 0.6 g/l Na-oleate | 26 | 27 | 28 |
| 0.6 g/l Na-oleate + 10 μM 2 | — | 17 | 15 |
| 0.6 g/l Na-oleate + 10 μM 3 | — | 22 | 20 |
| 0.6 g/l Na-oleate + 10 μM 4 | — | 24 | 23 |
| 0.6 g/l Na-oleate + 10 μM 5 | — | 24 | 23 |
| 0.6 g/l Na-oleate + 10 μM 6 | — | 18 | 17 |
| 0.6 g/l Na-oleate + 10 μM 7 | 24 | 16 | 15 |

Overall these results show that a combination of the catalysts with the sodium linoleate soap yields a wide stain removal profile without any added peroxy bleach species.

What is claimed is:

1. A bleaching composition comprising an organic substance which forms a complex with a transition metal for bleaching a substrate with atmospheric oxygen, the bleaching composition upon addition to an aqueous medium providing an aqueous bleaching medium substantially devoid of a peroxygen bleach or a peroxy-based or peroxyl-generating bleach system, said composition comprising a surfactant having an allylic hydrogen and said surfactant having an HLB of greater than 2, wherein at least 10% of any bleaching of the substrate being effected by oxygen sourced from the air.

2. A bleaching composition according to claim 1, wherein the surfactant is selected from the group of unsaturated cationics.

3. A bleaching composition according to claim 1, wherein the surfactant is selected from the group of unsaturated anionics.

4. A bleaching composition according to claim 1, wherein the surfactant is selected from the group of unsaturated neutral species.

5. A bleaching composition according to claim 1, wherein the surfactant is selected from the group of unsaturated zwitterionic species.

6. A bleaching composition according to claim 1, wherein the surfactant has an HLB of greater than 5.

7. A bleaching composition according to claim 6, wherein the surfactant has an HLB of greater than 10.

8. A bleaching composition according to claim 1, wherein the surfactant is present in the composition in an amount such that a unit dose provides at least 0.01 g/l concentration of the unsaturated organic compound in a wash.

9. A bleaching composition according to claim 1, wherein the surfactant has a CMC of $2\times10^{-2}$ M or less.

10. A bleaching composition according to claim 9, wherein the surfactant is anionic and has a critical micelle concentration value of $3\times10^{-3}$ M or less.

11. A bleaching composition according to claim 1, wherein the surfactant has molecular weight of at least 80 and the allylic hydrogen has bond dissociation energy of less than 90 kcal/mol.

12. A bleaching composition according to claim 1, wherein the surfactant is present in the composition in the range of 0.01 to 60% wt/wt.

13. A bleaching composition according to claim 12, wherein the surfactant is present in the composition in the range of preferably 0.1 to 20% wt/wt.

* * * * *